United States Patent [19]

Mayenschein

[11] 4,077,198

[45] Mar. 7, 1978

[54] CLOCK APPARATUS

[76] Inventor: Harley Mayenschein, 1700 W. Weathersfield Way, Schaumburg, Ill. 60194

[21] Appl. No.: 754,758

[22] Filed: Dec. 27, 1976

[51] Int. Cl.[2] ..... G04F 1/00

[52] U.S. Cl. ..... 58/1 R; 58/2; 58/144

[58] Field of Search ..... 58/2, 3, 1, 45, 50 R, 58/46, 4 B, 29, 30, 129, 144

[56] References Cited

U.S. PATENT DOCUMENTS

| | | | |
|---|---|---|---|
| 2,417,641 | 3/1947 | Fischer | 58/144 |
| 3,522,701 | 8/1970 | Perry | 58/1 R |
| 3,672,149 | 6/1972 | Howard | 58/2 |
| 4,024,701 | 5/1977 | Corson | 58/144 |

FOREIGN PATENT DOCUMENTS

| | | | |
|---|---|---|---|
| 14,033 | 7/1855 | France | 58/2 |

OTHER PUBLICATIONS

Collectors Dictionary of Clocks, H. Alan Lloyd, 1964, pp. 60,34,35.

*Primary Examiner*—Robert K. Schaefer
*Assistant Examiner*—Vit W. Miska
*Attorney, Agent, or Firm*—Lester N. Arnold

[57] ABSTRACT

A novel clock apparatus is provided which visually indicates attained time of day by the design of the placement order of free movable spheroids on a pivotable spheroid holder member effective to be sustained in a first stable position whereby spheroids can be loaded thereon to be positioned with reference to time related indicia numerals thereon until the number of such spheroids are then effective to cause pivoting of said holder member to a second stable position whereby loaded spheroids can be unloaded therefrom to place such unloaded spheroids into a closed or endless loop motion system whereby collecting means collect the unloading spheroids for reuse and time reference loading means reuse the unloaded spheroids against a predetermined time reference unit such as a minute by reloading the spheroids on to the holder member.

16 Claims, 7 Drawing Figures

CLOCK APPARATUS

BACKGROUND OF THE INVENTION

This invention relates to a novel clock apparatus, and more particularly, to an improved handless clock device providing continuous visual display of time of day indications from the positioning of ever-changing numbers of ball-like spheres maintained at rest upon pivotable stacked holder members.

The present invention is intended to provide clock means for use in indicating time of day (T.O.D.) in hours and minutes and simultaneously to delight and enrapture the observer by a relatively continuous visible movement of the ball-like spheres being loaded onto or unloaded from forwardly-mounted pivotable tiered holder members, hereinafter referred to as holders. The clock device comprises a plurality of interconnecting channel-like chutes or aisles serving as aisle means which means become aligned with pivoted or tilted holder members for receiving an unloaded train of spheres therefrom whereby the movement of spheres along the aisle means is at once both eyecatching and functional so as to permit a different combination of spheres to become repositioned on the holder members for indicating the next-attained current time of day. Some spheres of the unloaded train of spheres are retained to comprise the current time of day combination while other surplus spheres are returned to a preselected portion of said aisle means for storage of the spheres. A controlled movement pick-up member arm is provided to then remove an available one of such surplus spheres concurrently with the passage of each minute of time for redepositing the same into the visually displayed combination of spheres resting on the holder members for maintaining current time of day. The redeposit of such surplus spheres inevitably cause the overbalancing and unloading of the holders through the pivotable movement thereof. Current time of day is maintained through means of the changing of the displayed combination of spheres through the utilization of the predetermined load balancing capacities of each pivoted holder.

Clock devices comprise very popular consumer items and conventionally employ a variety of intricate and complex mechanical linkages and moving parts. Clock faces most often have movement hands to represent time of day when their angular positions are viewed against standard indicia of numerals. Clock devices use movement and sound such as depending pendulums and chimes to intrigue the viewer. Time of day references are given through use of alphanumerical and digital numeral displays. Very often, clock devices become popular consumer items just as well through the aesthetic configuration and visual aspects of the clock device as through the functional accuracy thereof in maintaining an exact indication of time of day. In such a crowded and well known field of invention, the present clock device provides means for measuring time in the form of a clock apparatus which indicates time of day without the utilization of angular referenced movement hands or a lighted digital display and without a large number of intricate mechanical parts and linkages, but with an unusual manner displaying current time of day indications, with a timing accuracy maintainable to the nearest minute, with contrasting openness and simplicity for permitting observation of the static position of stacked spheres followed by motion of the unloaded spheres which motion has the effect of immediately capturing the continued interest of the viewer. The present clock device provides a closed endless loop motion system wherein time of day can be continuously maintained without any resetting or reactivation of mechanical clock movement or recharging of power source and for which the recalibration function is done simply by adding or subtracting spheres at rest on the holder members.

In a preferred embodiment of the novel clock device, there is provided a sphere train clock apparatus comprising in combination a base member including vertically aligned support means thereon, a plurality of generally elongated holder members supported by said support means for pivoting movement about pivot axes selectively positioned along the intermediate lengths thereof, respectively, means for biasing any of said holder members into one pivoted position thereof, a plurality of spherical units, selected first ones thereof being contained on said holder members, the numbers of which spherical units indicate current time of day, loading means for loading selected second ones of said spherical units onto said holder members, predetermined ones of said selected second spherical units comprising means for counter biasing said holder members into opposite pivoted positions thereof, respectively, whereby said contained spherical units are unloaded therefrom, and means for collecting said unloaded spherical units for inclusion with said selected second spherical units for providing reloading thereof by said loading means.

More specifically, the clock apparatus of the present invention includes in combination a base member of generally rectangular configuration, a number of vertically aligned post members attached to and extending upwardly from the base member, vertically stacked generally elongated holder members supported on forwardly mounted ones of said post members for pivoting movements about their pivot axes selectively positioned traversely along the central intermediate lengths thereof, respectively, first biasing means for biasing the elongated holder members to remain in first extreme pivoted positions thereof, respectively, a plurality of spherical ball bearing means predetermined numbers of which are to be loaded onto said elongated holder members before being weight effective to overcome the bias of said first biasing means and causing pivoting movement of said overloaded holder members to second and opposite extreme pivoted positions thereof, respectively, whereby said loaded ball bearing means are unloaded in a continuous train of moving ball bearing means, vertically stacked chute assemblies supported on other post members for being aligned with the pivoted ones of said holder members, respectively, to receive said unloaded trains of moving ball bearing means, said chute assemblies being interconnected to channel said moving ball bearings to a selected one of said chute assemblies which comprises a storage chute assembly for surplus ball bearing means, timing reference means having an extended arm portion thereof being driven in a continuous circulating pattern for completion of one revolution each minute, said timing reference means effective during one revolution thereof to on-load a selected surplus ball bearing from the storage chute assembly and to off-load said selected ball bearing onto a predetermined one said holder members wherein said predetermined holder member is the topmost of the vertically stacked holder members, and selectible ones of said unloaded ball bearing means from said holder members, other than the lowermost of said holder members, being reserved during unloading thereof for loading onto an immediately lower one of said holder members whereby a new-current time of day indication is then provided from a representation of the collected numbers of ball bearing means being retained in the loaded position on all of said holder members.

SUMMARY

It is therefore an object of the present invention to provide an improved and novel clock apparatus giving visual time of day indications without the use of mechanical hands or arms or without a display of lighted numerals as in so-called digital displays.

It is another object to provide a handless clock apparatus displaying ever-changing numbers of spherical units to represent attained current time of day indications.

It is still another object to provide that the spherical units are ball bearing type units.

It is yet another object of the invention to provide a handless clock apparatus which provides repeated visual movements of balls being loaded or unloaded from time of day indicators.

It is yet still another object to provide that the time of day indicators comprise pivotable elongated shallow tray containers herein called holder members which are biased to one of two pivotable positions until the number of balls thereon cause overbalance thereof for causing movement of said holders to the second pivotable position and unloading of the balls.

It is a further object to provide collecting chute assembly means for collecting the unloaded balls and providing the same to become accessible to ball loading means to be loaded onto a selected holder member.

It is still a further object to regulate the loading action of said ball loading means to load balls against a selected time reference.

It is yet a further object to provide time of day indications of hours and minutes through the use of the number of collected balls contained on at least an hour holder member and a minute holder member, respectively.

A clock apparatus includes a base member, a plurality of vertically extending post members supported by said base member, chute assembly means supported by said post members, a plurality of spherical ball members collected by said chute assembly means, a plurality of generally elongated shallow tray container members pivotably support by said post members and being movable between a first stationary position in which said ball members are selectively loaded on said container members with respect to a predetermined time reference and a second stationary position in which said ball members are unloaded from said container members, said container members when in said second stationary postion thereof being aligned with said chute assembly means for unloading said ball members onto said chute assembly means, and loading means for loading selected ones of said ball members from said chute assembly means onto a preselected one of said container members.

Other objects and advantages of the present invention will naturally occur to those skilled in the pertinent art as the invention is described in connection with the accompanying drawing in which:

THE DRAWING

DETAILED DESCRIPTION

Figure 1:
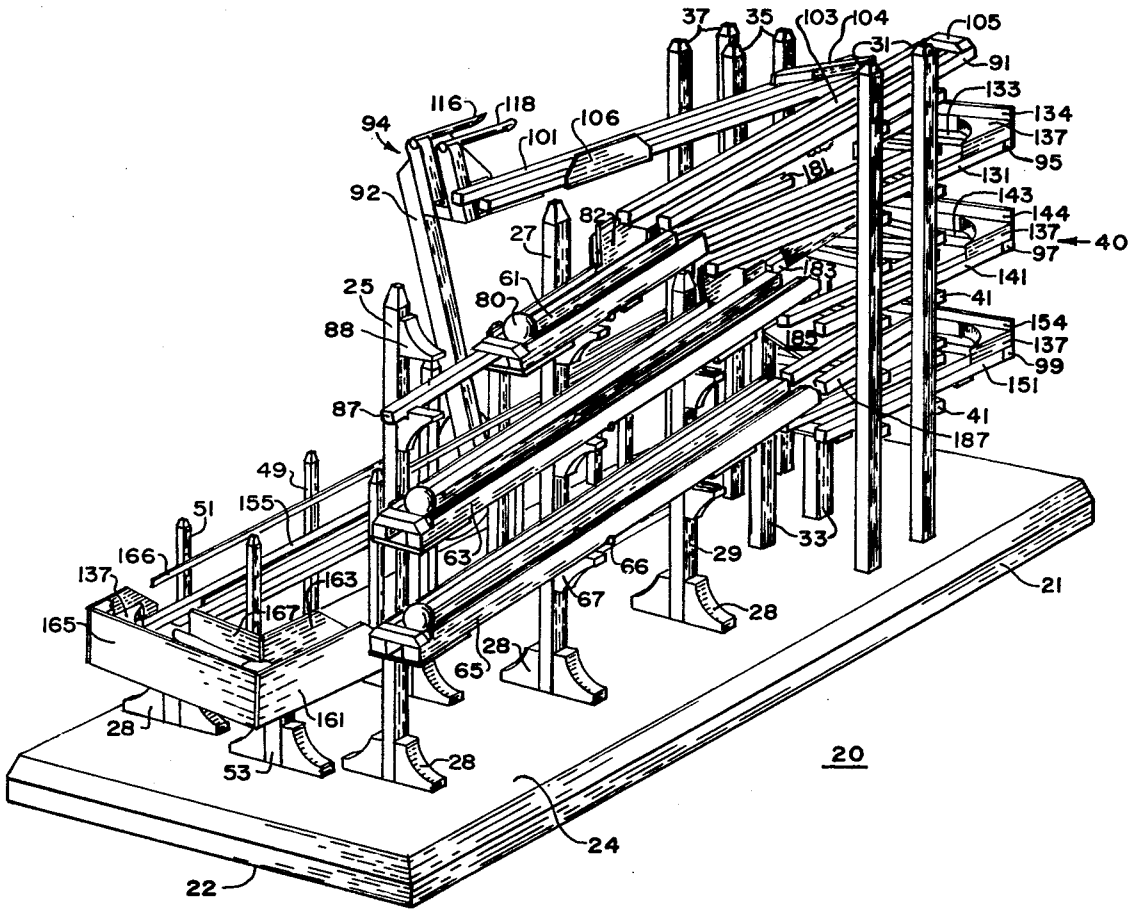
FIG. 1 is a left-handed frontal perspective view of a clock apparatus constructed in accordance with the present invention.

FIG. 1 shows a clock timing device or apparatus 20 generally of the handless variety, that is, wherein hand or arm extension members are omitted in providing a visual reference for ascertaining attained time of day indications. The clock device 20 includes a base member 21 of a preselected thickness dimension. The base member 21 is generally rectangularly shaped and has a bottom wall 22 upon which the clock device 20 rests and a top wall 24 which serves to support the numerous component parts of the clock device 20 as are hereinafter described with particular detail.

There are provided three support post-like members 25, 27 and 29 arranged in generally a frontal in-line alignment along the top wall 24 of the base member 21 and suitably attached and supported for vertical extension upwardly therefrom by pairs of opposing brace or footing members 28. Referring generally to FIGS. 1–4, a plurality of other support posts are shown to be provided to extend vertically upwardly from the base member 21, and are of various length dimensions as suited to the support function required of the application within the structure of the clock device 20. Two opposing pairs of support posts, comprised of post pair 31 and post pair 33, are provided and are positioned forwardly along the base member 21. Two other opposing pairs of support posts, comprised of post pair 35 and post pair 37, are positioned rearwardly along the base member 21. Chute or channel assembly means 40 are supported in vertically tiered or stacked levels on multiple ones of lateral cross-members 41 which extend between the support posts 31, 33 and 35, 37. Still other opposing pairs of support posts 43, 45, 47, 49 and 51 are provided for use in supporting a rearwardly disposed portion of the chute assembly means 40, such support posts being more clearly shown in FIG. 4. Support posts 53 and 55 are provided for supporting a terminal end portion of the chute assembly means 40. Support posts 57 and 59 are provided to support timing reference drive means 60 as will be more fully described hereinafter. Other opposing pairs of the brace or footing members 28 are used to brace the vertically aligned support posts as shown in the accompanying drawing.

Figure 2:
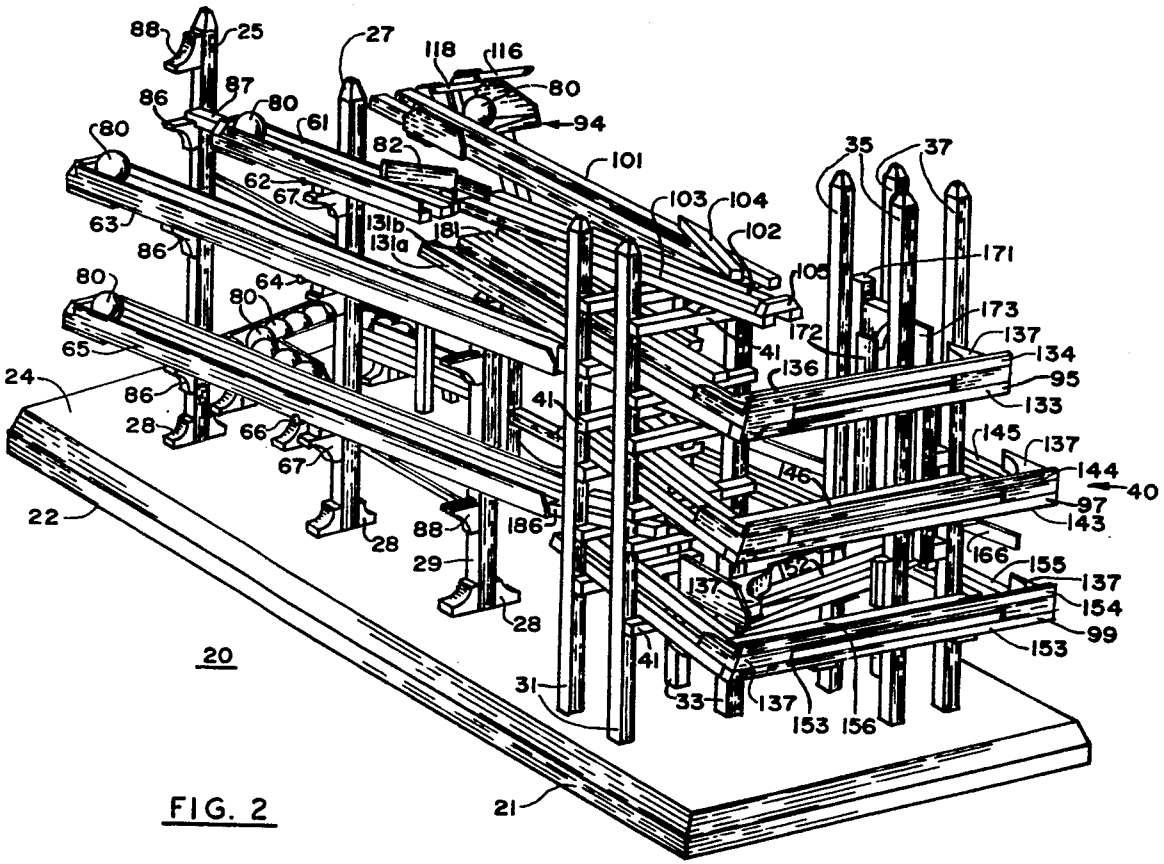
FIG. 2 is a right-handed frontal perspective view of the clock apparatus of FIG. 1.
Figure 3:
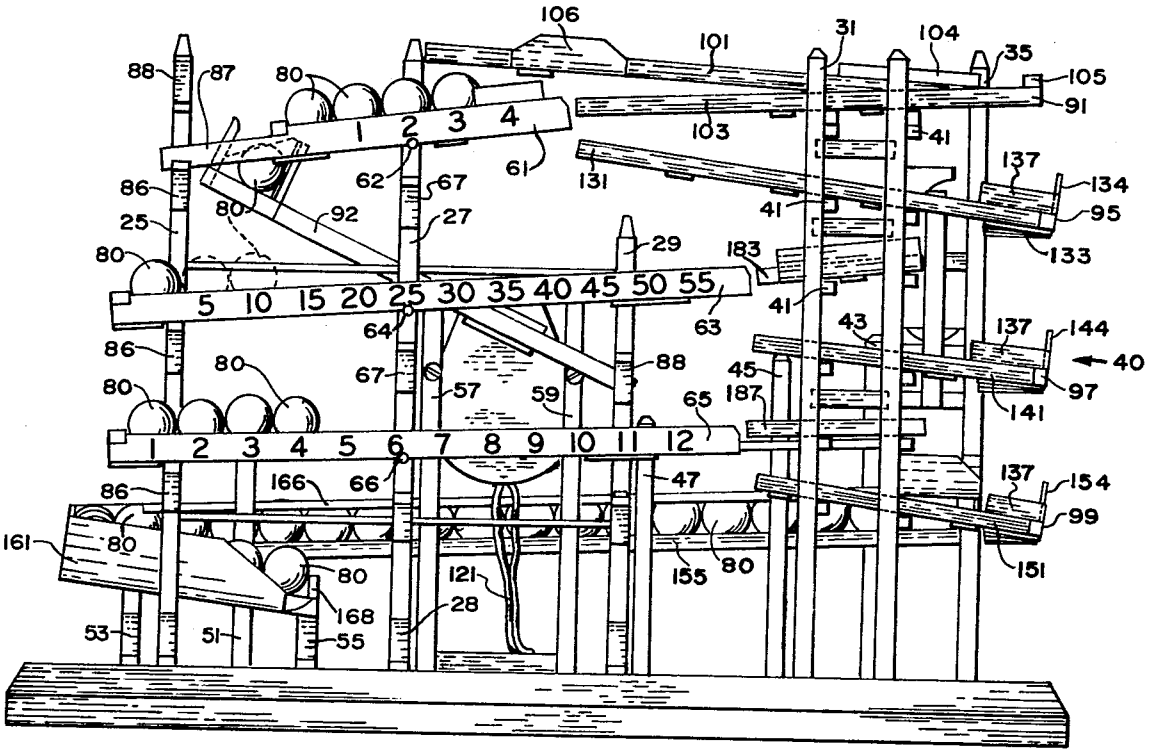
FIG. 3 is a direct front view of the clock apparatus of FIGS. 1 and 2.
Figures 6, 7:
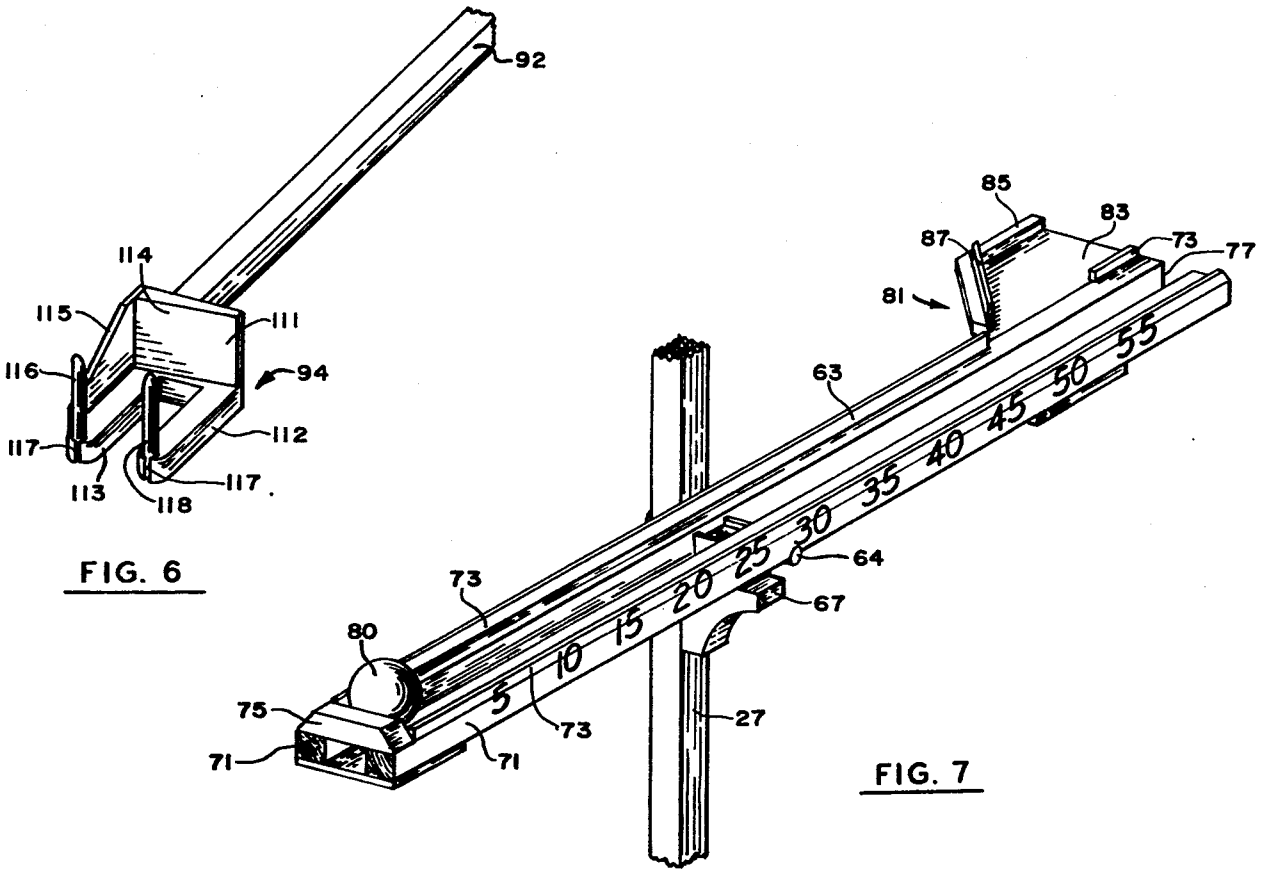
FIG. 6 is a fractional perspective view of a selected portion of the clock apparatus showing scooping means useful with the invention.
FIG. 7 is a fractional perspective view of another selected portion of the clock apparatus showing a shallow tray-like container serving as a holder member for a number of ball bearings.

FIGS. 1–3 clearly show a plurality of generally elongated shallow tray-like container or holder members 61, 63 and 65 being supported for pivotable movement about pivot axes formed by pins 62, 64 and 66, respectively. The pivot pins 62, 64 and 66 are disposed to extend transversely of the length dimensions of the holder members 61, 63 and 65 generally along the intermediate lengths thereof, respectively. The pivot pins 62, 64 and 66 are supported by suitable rights angle brace members 67 attached to the vertical post 27. The holder members 61, 63 and 65 are supported in vertically tiered or stacked levels and each is comprised of a bottom wall, opposing side walls, an end wall defining a closed end portion and having an opposite open end portion thereof. The holder member 63 is shown clearly in FIG. 7 and includes a grooved bottom wall defined by a pair of spaced-apart elongated runner members 71, opposing side wall runner members 73, and an end wall member 75 defining a closed end portion thereof. An opposite end portion is an open end portion as indicated at 77 in FIG. 7. A side tray holder member 81 is attached laterally to a selected side wall along the open end portion 77 of the holder member 63 as shown in FIG. 7. The side tray 81 includes a bottom wall 83 and side walls 85 and 87. The holder members 61 and 65 are identical in construction to the holder member 63; hence, a redundant recitation of constituent parts is not included herein. Further, the holder member 61 is accompanied by a side tray holder member 82 attached laterally to the open end portion thereof, and having a bottom wall and side walls like the bottom wall 83 and the side walls 85 and 87 of the side tray 81.

The holder members 61, 63 and 65 comprise holding means for a plurality of spheroids or spherical roller members or units 80 conveniently embodied as ball bearings of a predetermined diameter and mass. The holder members 61, 63 and 65 are pivotable about their pivot axes, respectively, between first stable or static positions, FIGS. 1–3, in which the open end portions thereof are slightly tilted or raised with respect to the closed end portions, and second stable or static positions wherein the reverse relationship is then established, that is, the closed end portions thereof are raised with respect to the open end portions thereof. The first and second stable positions of the holder members 61, 63 and 65 comprise extreme opposite pivotable positions thereof, respectively.

The holder members 61, 63 and 65 are initially biased into their first stable positions by the fixed attachment of single ball bearings 80 on the extreme closed end portions of the holder members, respectively, as provided by the ball 80 when positioned substantially abutting the end wall member 75 of the holder member 63 in FIG. 7. The single ball bearings 80 which bias the holder members 61, 63 and 65 into their first stable positions comprise first biasing means to restrain the holder members 61, 63 and 65 to maintain their first stable positions to permit the entry of and retention of other ball bearings 80, as shown in phantom on the holder members in FIG. 3.

Additional ball bearings 80 are then stacked end to end adjacently to each other in an in-line train of ball bearings 80 acting to reinforce the first biasing means, that is, until such additional ball bearings 80 begin to extend across the pivot axes of the holder members to then comprise counter-balancing means to the first biasing means. It is at once obvious that upon the addition of ball bearings 80 which comprise counter-balancing means, that when the mass of the counter-balancing means exceeds the mass of the first biasing means, the holder members will be caused to pivotally move from their first stable positions to their second stable positions.

When in the first stable positions thereof, the holder members 61, 63 and 65 have the closed end portions thereof positioned at rest against shoulder brace members 86 affixed to the vertical post 25. When in the second stable positions thereof, the open end portions of the holder members 63 and 65 are brought to rest against shoulder brace members 88 affixed to the post 29. The holder member 61 is brought to rest in the second stable position thereof through the provision of a holder extension arm 87 abutting another shoulder brace member 88 attached to the post 25. The first and second stable positions for the holder members 61, 63 and 65 are referred to as the loading and unloading positions, respectively, with respect to the ball bearings 80 for reasons which will become apparent from a detailed consideration of the following disclosure.

The chute assembly means 40 comprise means for collecting and storing the ball bearings 80 which balls are unloaded from the holder members 61, 63 and 65 when the same have moved to the second stable positions thereof, respectively. The retained ball bearings 80 are biased by gravity to assume an unloading movement because of the raised or tilted position of the closed end portion over the open end portion of the holder members 61, 63 and 65. It is to be noted that the fixedly attached ball bearings 80 which comprise the first biasing means remain in place during unloading movement of the unattached ball bearings 80. Immediately following the unloading of all unattached free-moving ball bearings 80, the first biasing means are effective to cause the return of the holder members 61, 63 and 65 to the first stable positions thereof. The chute assembly means 40 are comprised of a plurality of vertically tiered or stacked levels of chute or channel assemblies configured as shallow tray-like aisles or track members suitable to guide movement of the ball bearings 80 therealong.

A first chute assembly thereof 91 is supported primarily by the support post pairs 31 and 33 and is positioned to comprise the topmost of the multiple stacked levels of chute assemblies of the chute assembly means 40. The first chute assembly 91 is comprised of two separate aisle or track sections 101 and 103 which have adjacent side walls placed to be contiguous with respect to each other at a location therealong which is hereinafter referred to as a cross-over 102. The two track sections are supported so as to tilt in opposite tilting directions, that is, the track section 101 tilts generally upwardly from the so-called cross-over 102 to effect a continued downward rolling movement of a ball bearing 80 from the upper portion of the track section 101 and over to the track section 103 from the cross-over 102 and then downwardly along the track section 103.

It is according to a principle of the present invention to provide loading means 90 by which to cause the deposit of a single ball bearing 80 on to the track section 101 of the first chute assembly 91 with respect to a predetermined timing reference unit, herein selected to be a full minute (60 seconds). The precision of the uniformity of time elapsed between deposits of these single ball bearings 80 by the loading means 90 determines the timing accuracy of the clock device 20. Each such ball bearing 80 is unloaded from the track section 103 of the topmost chute assembly 91 on to the holder member 61 by entry from the side tray 82. The track sections 101 and 103 are configured similarly to the configuration of the holder members 61, 63 and 65 as hereinbefore described in detail with reference to FIG. 7. The track sections 101 and 103 are comprised of suitably interconnected parallel spaced side members (unnumbered in the drawing), a cross-over guide member 104 and an end wall member 105 for the track section 103, FIG. 2. A raised side wall member 106 is conveniently provided along the upper portion of the track section 101 at the place of entry of the ball bearing 80 to guard against misplacement of the ball bearing 80 on to the track section 101.

The loading means 90 is comprised of the aforementioned timing reference drive means 60, a radially disposed extension hand or arm member 92 pivotably attached to the drive means 60 by rotatable drive shaft means 93 (FIG. 4), and bucket or scoop means 94 attached to the extreme outer free end portion of the extension member 92. FIG. 6 shows the bucket means 94 more clearly than that shown in the remaining drawing. The bucket means 94 is comprised of a rear wall 111, a bottom wall 112 having an open channel or aperture 113 provided therein into which a loaded ball bearing 80 will extend for providing increased stability to the spheroid 80, a single side wall 115 serving to enclose the outer side of the bucket means 94, an inner cavity 114 and a pair of post members 116 and 118.

The post members 116 and 118 are parallel spaced and extend perpendicularly from the bottom wall 112. The post members 116 and 118 are shown in FIG. 6 to be attached to the bottom wall 112 through being insertedly received into apertures 117 as provided in the free edge portions of the bottom wall 112 being in turn defined by the aperture 113. The topmost portion of the post members 116 and 118 are suitably tapered to define beveled inclining surfaces, respectively, which inclined surfaces are aligned toward the inner cavity 114 of the bucket means 94. The bucket means 94 has one open side oppositely disposed from the enclosed side wall 115 through which open side, a loaded ball bearing 80 could be released for unloading on to the track section 101 of the chute assembly 91.

The timing reference drive means 60 has the twofold purpose of providing the source for driving the loading means 90, and in particular, the extension arm 92 and the attached bucket means 94, and also providing the timing reference by which to determine and control the cyclic rate at which the extension arm 92 is being driven. The timing reference drive means 60 has been selected in the present embodiment to be comprised of a 60 cycle synchronous AC electric motor having a rotatable drive shaft which serves as the drive shaft means 93. The 60 cycle electric motor is shown in the drawing to be connectible to a source of AC electric power through the provisions of an electric cord 121. Obviously, DC battery operated electric power sources could be utilized through commonly known DC to AC conversion techniques but are not disclosed as a part of this disclosure.

The 60 cycle synchronous AC motor 60 will drive the loading means 90 to complete one 360° revolution of the driven extension arm 92 with each 60 seconds of elapsed time, that is, one cycle per minute. Accordingly, a single ball bearing 80 is loaded into the bucket means 94 and unloaded for addition to the displayed number of ball bearings 80 each minute of elapsed time. The accuracy of the clock device 20 is then dependent upon the timing accuracy of the 60 cycle motor 60 but very acceptable tolerances are provided for commercially available 60 cycle synchronous electric motors. Further, recalibration of the clock device 20 is readily accomplished by the manual addition or subtraction of a ball bearing 80 to the displayed number of ball bearings 80 retained by the holder members 61, 63 and 65.

The chute or channel assembly means 40 is further comprised of a second chute assembly 95 generally underlying the topmost first chute assembly 91, a third chute assembly 97 generally underlying the second chute assembly 95, a fourth chute assembly 99 generally underlying the third chute assembly and constituting the lowermost one of said chute assemblies thereof. The second chute assembly 95 is supported by the post pairs 31, 33, 35 and 37 and is comprised of tandem aisle or track sections 131 and 133. The track section 131 is supported by the post pairs 31 and 35 to provide a slight downward incline from the left to the right as generally viewed in the drawing. Further, the track section 131 has an open free end portion which will become aligned with the open end of the holder member 61 upon the pivotal movement of the holder member 61 to the second stable position thereof for unloading the unattached spheroids 80 contained thereon.

The track section 131 is suitably configured to guide the rolling movement of any unloaded ball bearings 80 without loss thereof. In particular, the track section 131 is configured to be substantially the same in construction as the track section 101 and to the holder members 61, 63 and 65, that is, to provide a pair of parallel spaced elongated members **131*a* and 131*b* defining an opening therebetween which permits protrusion of the ball bearing 80 therein and opposite sided contact upon the movable ball bearing 80. It is thought to be unduly redundant to recite the detailed construction of each track section used in comprising the chute assembly means 40**, and all other track sections will be understood to be of the same channeled configuration.

The track section 133 extends perpendicularly to the track section 131 generally from front to rear of the clock device 20 to continue gravity fed impetus of movement to the ball bearing 80 traveling therealong. The rearward portion of the track section 133 is attached to adjacent ones of the posts 35 and 37 at a top level thereof. Lateral outer and inner side walls 134 and 136, respectively, comprise guard rail means to prevent the moving ball bearing 80 from undesired lateral displacement along the intermediate length of the track section 133. The length of the inner side wall 136 is terminated at the post 35 so as to define a lateral opening along the rearward end portion of the track section 133, disposed between the posts 35 and 37. Right angle rail or guide members 137 having arcuate inner surfaces thereof to cause the ball bearings 80 to complete a right angle turn without loss of travel speed or acceleration.

The third chute assembly 97 is supported by the post pairs 31 and 33 and by adjacent ones of the posts 35 and 37 and is comprised of tandem aisle or track sections 141, 143 and 145. The track section 141 is positioned to extend along the frontal portion of the clock device 20 and is supported by posts pairs 31 and 35 to have a slight downward incline from the track section 141, is open ended, having no end wall thereon, and will become aligned with the open end of the holder member 63 upon pivotal movement of the holder member 63 to the second stable position thereof for unloading the unattached spheroids 80 contained thereon. The track section 141 is configured generally the same as is the track section 131 except that the length of the track section 131 is greater because the length of the holder member 63 is greater than the length of the holder member 61.

The track section 143 also extends perpendicularly to the track section 141 generally extending from front to rear of the clock device 20 with a continued slight downward incline from front to rear of the clock device 20. The rearward portion of the track section 143 connects to another track section 145 provided on the rear of the clock device 20 extending perpendicularly from the track section 143. Suitable lateral outer and inner side walls 144 and 146, respectively, comprise guard rail means to prevent inadvertent loss or displacement of the moving ball bearings 80. The length of the inner side wall 146 is terminated at the post 37 so as to define an opening from the track section 143 on to the track section 145. The track section 145 is then open ended on the end opposite to the attachment to track section 143 for permitting moving ball bearings 80 to be dumped or exited therefrom. A pair of the right angle rail members 137 are utilized at the joinder of the track sections 141 and 143 and 143 and 145 to engage the moving ball bearings 80 and cause the same to complete right angle turns again without loss of speed or acceleration.

The fourth chute assembly 99 is comprised of tandem aisle or track sections 151, 153 and 155, suitably supported by a plurality of posts as shown in the drawing and as previously disclosed herein. The track section 151 is positioned to extend along the frontal portion of the clock device 20 and is provided with a slight downward incline from left to right. The raised end portion thereof is open ended and will become aligned with the open end of the holder member 65 upon pivotal movement of the holder member 65 to the second stable position thereof for unloading the unattached spheroids 80 contained thereon. The track section 151 is generally of the same configuration as track sections 131 and 141 with the exception of the length dimension thereof which is again somewhat shorter than the track section 131 because the holder member 65 is longer than the holder member 61.

The track secion 153 extends perpendicularly to the track section 151 generally extending from front to rear of the clock device 20 with a continued slight downward incline from front to rear thereof. Outer and inner side walls 154 and 156, respectively, comprise guard rail means to prevent inadvertent loss or derailment of the moving ball bearings 80. The length of the inner side wall 156 is terminated at the post 37 so as to define an opening on to the intersecting track section 155. The track section 155 intersects the rearward end portion of the track section 153 at right angles thereto and the track section 155 then extends along the rearward portion of the clock device 20 and then toward the central portion of the base member 21 for the loading of the ball bearings 80. The track section 155 is also provided with a continued slight downward incline to enhance the continued rolling movement of the ball bearings 80 therealong.

Figure 4:
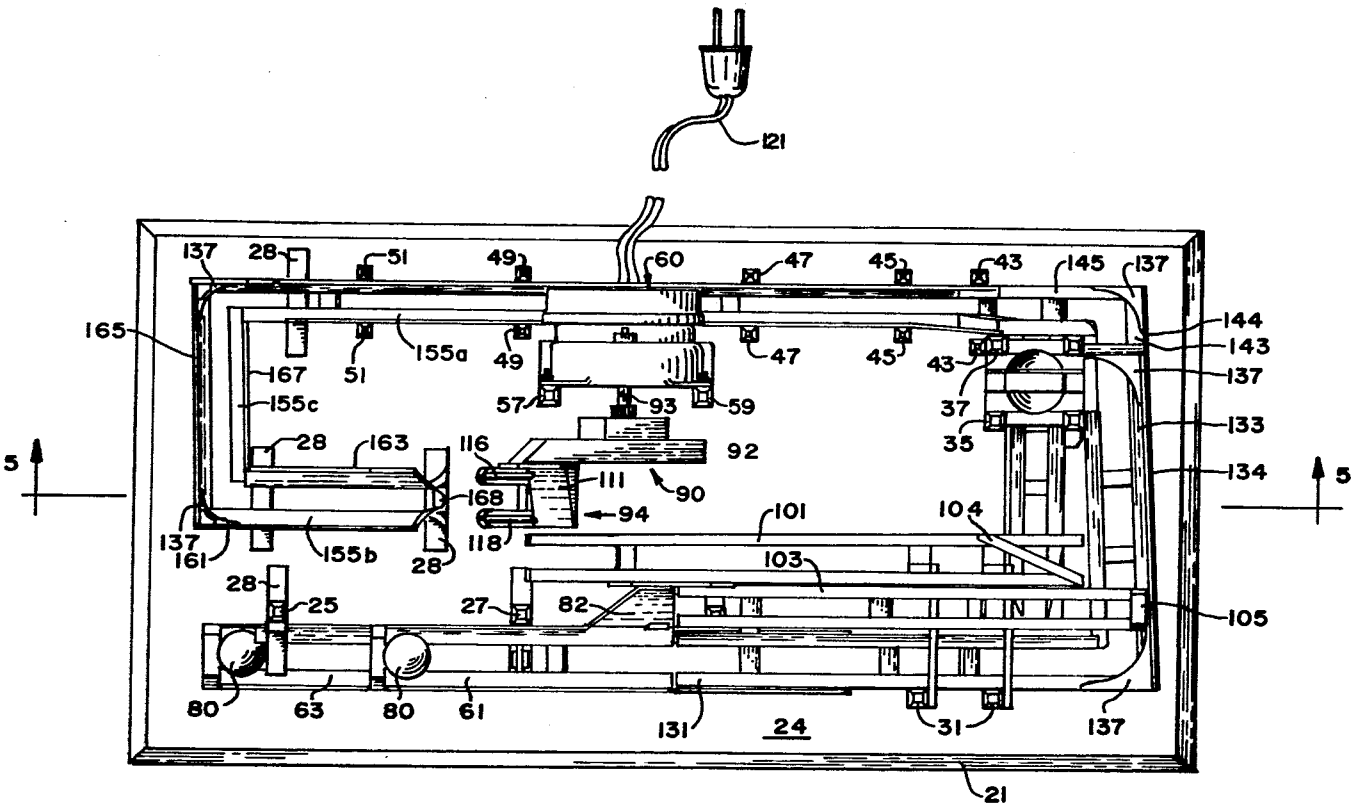
FIG. 4 is a top view of the clock apparatus of FIGS. 1 and 2.
Figure 5:
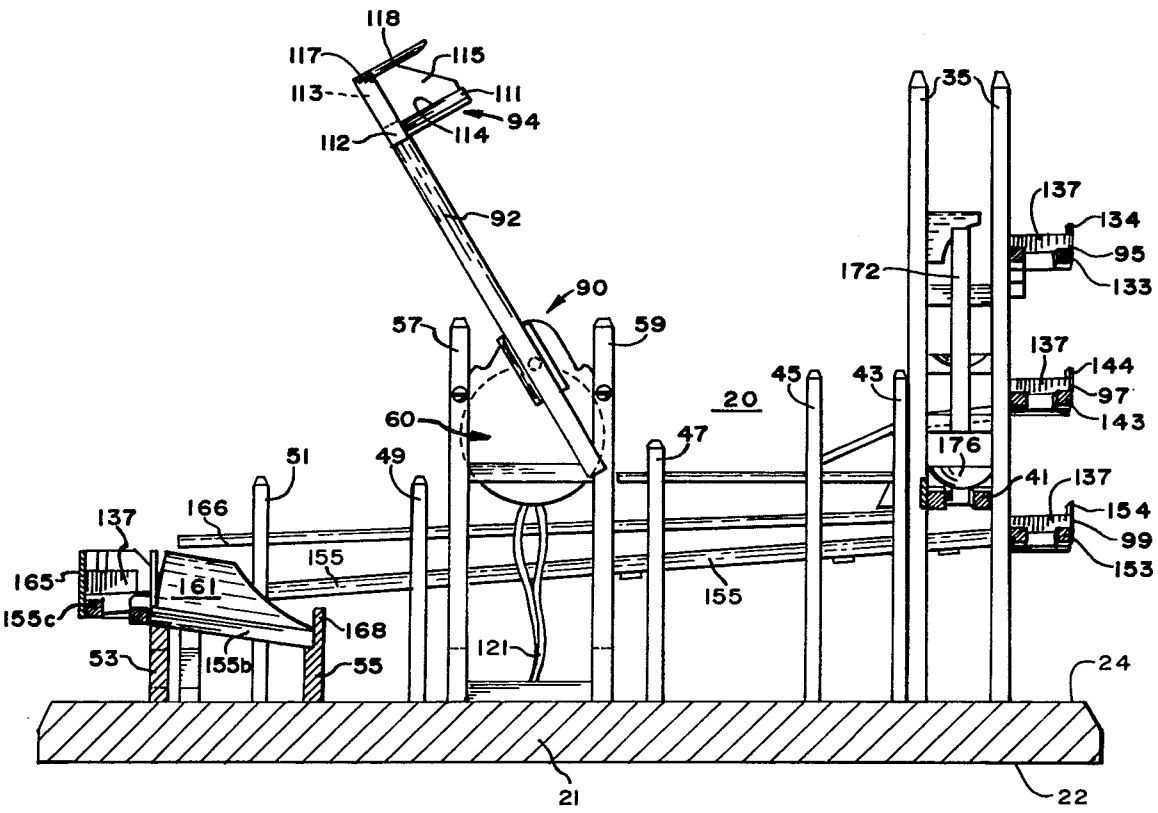
FIG. 5 is a cut-away view of the clock apparatus of FIG. 4 as taken generally along the reference line 5—5 shown in FIG. 4.

FIG. 4 shows a top view of the clock device 20 disclosing the general U-shaped configuration of the track section 155 wherein one leg portion 155*a* of the U-shape is generally elongated as compared to the other leg portion 155*b* of the U-shaped track section 155. The cross-connection of the U-shape is shown by the track section 155*c*. The track sections 155*b* and 155*c* are provided with outer and inner side walls 161 and 163 and 165 and 167, respectively, and the track section 155*a* is provided with oppositely disposed rail members 166 for guiding the moving ball bearings 80 therealong. The right angle rail members 137 are placed in each right angle intersection of the track sections 151, 153 and 155. The track section 155*b* comprises a terminal end portion for the chute assembly means 40 to which the unloaded ball bearings 80 move for reuse by being loaded into the bucket means 94. The unloaded ball bearings 80 along this track section 155 comprise the aforementioned surplus spheriods 80 and the terminal end portion thereof comprises storage means for the surplus spheriods 80.

The extreme terminal end portion of the track section 155*b* is extended beyond the side walls 165 and 167, and a suitable barrier such as post 168 is provided at the extreme terminal end portion against which an unrestricted moving ball bearing 80 will come to rest. The post 168 is intended to be sufficiently narrow to permit the post 168 to pass between the parallel spaced post members 116 and 118 as the bucket means 94 travels along its circumferential path of travel past the extreme terminal end portion of the track section 155*b*. The posts 116 and 118 are effective to literally lift or scoop the end ball bearing 80 into the inner cavity 114 of the bucket means 94. As the end ball bearing 80 is lifted away, an adjacent one of the stacked surplus ball bearings 80, see FIG. 3, moves down the slight incline of the track section 155*b* to come to rest against the post 168.

The spaced apart post pairs 35 and 37 comprise the four corners of a rectangular shaped vertical enclosure or chimney defined therebetween (not numbered in the drawing), and the spaces or intervals between corner posts are further restricted on three sides thereof by vertically aligned parallel spaced post members 171–173. The ball bearings 80 which are unloaded on to the second chute assembly 95 will exit the track section 133 between the posts 35 and 37 into the vertical enclosure or chimney at this top level thereof. The ball bearings 80 will free fall to a lower level of the vertical enclosure defined by a horizontal platform 176. The platform 176 preferably includes a partially concave cavity or depression formed therein into which the free falling ball bearings 80 plunge, and which platform 176 is positioned intermediately between the vertical levels of the third and fourth chute assemblies 97 and 99. A track section 152, FIG. 2, is used to interconnect the raised platform 176 and the lower track section 153 for guiding unloaded ball bearings 80 from the upper track section 133 to move on to the terminal track section 155 for reuse. The track section 152 is provided with one of the right angle rail members 137 at both end portions thereof in order to turn the moving ball bearings 80 through two 90° turns.

Additional track sections 181 and 183, FIG. 1, and an inclined platform 185 are used in the downward transfer of unloaded ball bearings 80 from upper level holder members to lower level holder members of the holder members 61, 63 and 65. The track section 181 is positioned inside the track section 131 to extend complanar therewith but is of much shorter length dimension. The track section 181 will become aligned with the side tray 82 of the holder member 61 when the holder member 61 is caused to be pivoted to the second stable position thereof whereby unloading of the ball bearings 80 is accomplished. The track section 183 is disposed directly beneath the upper track section 181 and is aligned to overextend the lowered end portion of the track section 181. The raised end portion of the track section 181 is the end portion which becomes aligned with the lowered pivoted holder member 61. The track section 183 is also oppositely inclined from the downward incline of the track section 181 from left to right in the frontal perspectives of the drawing. The track section 183 inclines downwardly from right to left and the left hand lowered end portion thereof is aligned with the side tray 81 of the holder member 63 when the holder member 63 is at rest in the first stable position thereof suitable to receive the loading of ball bearings 80.

There is provided on a vertical level generally aligned with the raised (left hand) end portion of the track section 141 and disposed laterally on the inner side thereof, the inclined platform 185. The platform 185 is selectibly either a single wall inclined surface having suitable side walls comprising guard rails, or optionally, may be comprised of several surfaces having different degrees of slope or incline. The nature of the platform 185 remains the same, that is, to provide a downwardly inclined ramp from the raised end portion of the track section 141 to the lower and laterally disposed track section 151. The raised end portion of the platform 185 becomes aligned with the side tray 81 when the holder member 63 is pivoted to the second stable position thereof whereby unloading of the ball bearings 80 is accomplished. The platform 185 then constructs a 90° turn and the lower end portion thereof is preferably terminated in alignment with access on to the intermediate length of another right to left downwardly inclined track section 187 disposed in vertical alignment with the track sections 141 and 151. The left hand lowered end portion thereof is aligned with the open end portion of the holder member 65 with the holder member 65 at rest in the first stable position thereof suitable to receive the loading of ball bearings 80 to complete a 180° routing of ball bearing 80.

Pursuant to the intended purpose of the clock device 20 to provide visual indications of time of day in hours and minutes, with accuracy to the nearest minute, the holder members 61, 63 and 65 are calibrated in their length dimensions so as to have each end-to-end adjacently stacked spheroid 80 represent either one minute of time, five minutes of time or one hour of time, respectively. FIG. 3 shows the frontal side wall of the holder member 61 to be suitably marked with indicia numerals one through four. The indicia numerals are spaced apart increasing from left to right so that the free moving (unattached) ball bearings 80 become aligned therewith when at rest subsequent to being loaded on to the holder member 61 by the loading means 90. The first ball bearing 80 to be loaded on to the holder member 61 rolls down the incline of the holder member 61 from right to left and comes to rest in alignment with the numeral one and in engagement with the stationary biasing ball bearing 80. The clock device 20 hence is visually indicating one minute of accumulated measured time of day.

The second ball bearing 80 to be loaded on to the holder member 61 is unloaded on to the track section 101 from the bucket means 94 and is added to the holder member 61, coming to rest in alignment with the numberal two and engaging the adjacent one minute ball bearing 80. The clock device hence is visually indicating two minutes of accumulated measured time of day. The third and fourth ball bearings 80 to be consecutively loaded come to rest on the holder member 61 to indicate three and four minutes, respectively, of accumulated measured time of day. It is at once apparent that the rightmost positioned free moving ball bearing 80 is the only one which need be read against its aligned indicia numeral in order to read the measured time of day for the particular holder member. The holder member 61 is now loaded with a fixed ball bearing 80 and four unattached movable ball bearings 80 and yet the holder member 61 remains at rest in the first stable position thereof. All of the ball bearings 80 positioned to the left side (FIG. 3) of the pivot axis 62 serve as the first biasing means to retain the pivotable holder member in the loading position therefor. The ball bearings 80 positioned to the right side (FIG. 3) of the pivot axis 62 serve as counterbalancing forces or biasing means to reduce the accumulated first biasing means.

Now, the fifth ball bearing 80 to be loaded on to the track section 101 moves downwardly on to the track section 103, and then on to the side tray 82 of the holder member 61. The weight of the fifth ball bearing 80 constitutes the overbalancing ball bearing 80 wherein the accumulated counterbalancing force is greater than the first biasing means and consequently, the holder member 61 is pivoted at once to the second stable position thereof for permitting the unloading action of the movable ball bearings. Additionally, the fourth ball bearing 80 resting on the holder member 61 constitutes a barrier to the entry of the fifth ball 80 on to the holder member 61 from the side tray 82. The moving ball bearings 80 continue during unloading to bear upon the right hand side of the pivoted holder member 61 with sufficient force to retain the holder member 61 in the second stable position thereof until all movable unattached ball bearings 80 are removed (unloaded) from the holder member 61. Thereafter, the remaining fixed ball bearing 80 comprises sufficient force as first biasing means to cause the holder member 61 to at once return to the first stable position thereof suitable to again receive loading ball bearings 80. With the addition of the fifth ball bearing 80 to the side tray 82, the pivotal movement of the holder member 61 is immediate and the fifth ball bearing 80 remains upon the side tray 82 to be unloaded on to the aligned track section 181. The unloaded fifth ball bearing 80 moves down the track section 181 dropping on to the vertically aligned and overextended track section 183, and hence, on to the holder member 63 via the side tray 81.

The holder member 63 is suitably marked with indicia numerals repeating one numeral for each five minutes and counting 5 through 55, inclusive. The indicia numerals are spaced apart increasing the count thereof from left to right so that each of the free moving (unattached) ball bearings 80 being loaded thereon become aligned with each of the five minute indicia numerals, stacking progressively from left to right. The fifth ball bearing 80 which was first added to the holder member 63 as described above, moves down the incline thereof and comes to rest in alignment with the numeral 5 and then engages the stationary biasing ball bearing 80 thereon. The clock device 20 hence is visually indicating five minutes of accumulated measured time of day.

The sixth through the ninth ball bearings 80 which are added to the clock device 20 by the loading means 90 are retained on the holder member 61 to visually indicate six minutes through nine minutes, respectively, when the occupied indicia numerals of both the holder members 61 and 63 are added together. The tenth ball bearing 80 to be loaded causes the same overbalancing effect on the holder member 61 as did the fifth ball bearing 80, and the result is that the tenth ball bearing 80 is added to the holder member 63 via the track sections 181 and 183. The clock device 20 hence is visually indicating ten minutes of accumulated measure time of day. With the holder member 61 pivoted to the second stable position thereof suitable for unloading action, it is seen that the previously accumulated four ball bearings 80 move on to the chute assembly 95, down the chimney formed between the posts 35 and 37 and on to the chute assembly 99. These ball bearings 80 then move on to the terminal track section 155 to be stored thereon for reuse in loading. A sufficient number of the ball bearings 80 are always retained in storage as surplus ball bearings 80 so as to permit the maximum number of ball bearings 80 to be accumulated in the loaded position on the holder members whereby the clock device 20 reads 12:59 (either A.M. or P.M.).

The eleventh through the fourteenth progressively added ball bearings 80 serve to add another four minutes to the accumulated measured time of day, respectively, when added to the rightmost occupied indicia numeral of the holder member 63. The fifteenth progressively added ball bearing 80 again has the resulting effect of pivoting the holder member 61, and is thus added to the holder member 63 to become aligned with the indicia numeral fifteen, as the eleventh through the fourteenth ball bearings 80 are added to the surplus stored ball bearings 80 on the chute assembly 95. This loading and unloading action for the holder member 61 thus is repetitive and the holder member 63 begins to accumulate a stacked train of spheroids 80 until the holder member 63 accumulates a total of eleven free moving ball bearings 80. The twelfth ball bearing 80 to be added to the holder member 63 has the resulting effect of overbalancing the pivotable holder member 63 to move the same to the second stable position thereof whereby the free moving ball bearings 80 previously loaded thereon are unloaded on to the chute assembly 97 and the newly added twelfth ball bearing 80 is added instead to the holder member 65. Thus, it is apparent that the holder member 63 is unloaded once each hour of accumulated measured time of day whereas the holder member 61 has been shown to be unloaded once each five minutes of accumulated measured time of day.

The twelfth ball bearing 80 to be progressively added to the holder member 63 comprises the sixtieth progressively added ball bearing 80, that is, one ball bearing 80 for each accumulated minute of measured time of day. Hence, the sixtieth such added ball bearing 80 comprises an addition to the holder member 65 which is used to measure accumulated hours. The holder member 65 bears the indicia numerals 1 through 12 to represent twelve hours. The stationary ball bearings 80 fixed thereon for the first biasing means is always aligned with the indicia numeral one for indicating one hour of accumulated measured time of day. The sixtieth such added ball bearing 80 moves therealong to become aligned with the numeral two on the holder member 65. At this point, the holder members 61 and 63 are entirely void of retained ball bearings 80, and the clock device 20 is visually indicating two hours of accumulated measured time of day. The above process is then repeated in the entirety thereof until the one hundred and twentieth progressively added ball bearing 80 is added to the clock device by the loading means 90, and is thus added to the holder member 65 in alignment with the numeral three for indicating three hours of accumulated measured time of day. The holder member can retain up to and including twelve such one-hour indicating ball bearings 80 (including the stationary ball bearings 80 fixed thereon) while remaining in the first stable position thereof. However, the addition of the twelfth such added ball bearing 80 is effective to overbalance the holder member 65 to pivot the same to the second stable position thereof whereby all free moving ball bearings 80 thereon are off-loaded on to the chute assembly 99. The simultaneous unloading action of the holder members 61, 63 and 65 occurs each time that the holder member 65 is off-loaded. This action occurs each time the clock device 20 is indicating 1:00, either A.M. or P.M.

In a preferred embodiment of the invention, the clock device 20 has been constructed of light weight wood such as balsa but it is apparent that a variety of other equally suitable materials such as acrylics, plastics, etc., could be substituted. Further, the holder members 61, 63 and 65 and the chute assembly 40 and numerous support posts have been configured with a generally rectangular cross-section but other cross-sectional configurations including a circular cross-section could be readily utilized. The support posts such as 25, 27 and 29 are braced by footing members 28 but such posts could be as equally stabilized by other techniques such as being embedded into the base member 21. The overall size of the clock device 20 is not considered to be critical except to retain the balancing loading and unloading effect of the pivotable holder members 61, 63 and 65. For example, the spheroids 80 have been conveniently selected to be common ball bearings of a § inch diameter and preferably nickel plated, but could be of a different diameter larger or smaller. The spheroids 80 could be selected to be non-ball bearings such as any diameter spheroid type object having suitable mass to effect the balancing loading and unloading effect of the pivotable holder members 61, 63 and 65. Such spheroids 80 could be made to simulate the appearance of various sporting event related game balls such as baseballs, bowling balls, basketballs, etc., in order to enhance the desirability of owning such a clock device 20 or merely enhancing the interest of the viewer thereof. The various parts are preferably glued together when the clock device 20 is constructed of wood, and the clock devices 20 are found to be strong and sturdy in construction and easily repaired. The fixed stationary ball bearings 80 affixed on the leftmost end portion of the three holder members 61, 63 and 65, respectively, are preferably glued to the wooden holder members. An alternative method would be to provide an underlying metal plate or base of suitable size and being relatively thin in the thickness dimension, and fusing or welding the nickel plated ball bearings 80 thereto.

While the present invention has been shown and described with reference to the preferred embodiments thereof, the invention is not limited to the precise forms set forth herein, and various modifications and changes may be made without departing from the spirit and scope thereof.

What is claimed is:

1. A clock apparatus including a base support member, a plurality of spheroids, spheroid holder means movable between first positions thereof aligned to receive moving spheroids thereon and second positions thereof aligned to depart moving spheroids therefrom, time of day indication numerals thereon and said moving spheroids coming to rest thereon in progressive alignment with next higher order indication numerals, first biasing means effective to bias said spheroid holder means into said first position thereof, counter-biasing means to said first biasing means effective to overcome said first biasing means and to bias said spheroid holder means to move to said second position thereof, chute assembly means receiving said moving departing spheroids from said spheroid holder means and collecting said moving departing spheroids for storage thereof, and time referenced loading means for loading with predetermined time referenced motion thereof said stored spheroids to be moved on to said spheroid holder means whereby the placement order of said spheroids indicates attained time of day.

2. A clock apparatus comprising in combination support structure means, a plurality of separable spheroid means, spheroid holder means movably supported on said support structure means, said spheroid holder means having spaced time-of-day referenced increasingly higher order indicia numerals thereon and being effective to guide moving spheroids thereon and to retain said spheroids when brought to rest, said moving spheroids being progressively brought to rest in an end-to-end adjacently stacked train of spheroids positioned in progressive alignment with next higher ordered ones of said indicia numerals, first biasing means effective to bias said spheroid holder means to receive and retain said spheroids thereon, second biasing means effective to overcome said first biasing means for moving said spheroids from said spheroid holder means, collection means for receiving said spheroids from said spheroid holder means and providing storage therefor, and time referenced loading means for loading with pretimed motion thereof said stored spheroids on to said spheroid holder means whereby the progressive alignment order of said spheroids indicates attained time of day measurements as read from the aligned indicia numerals.

3. The clock apparatus of claim 2 wherein said spheroid means comprise a plurality of ball bearing means of uniform diameter and mass.

4. The clock apparatus of claim 2 wherein said spheroid holder means are pivotably mounted on said support structure means and movable between a first tilted position thereof inclined to receive and retain moving spheroids thereon and a second tilted position thereof inclined to depart moving spheroids therefrom, said first biasing means biasing said spheroid holder means into said first tilted position thereof, and said second biasing means biasing said spheroid holder means to overcome said first biasing means to bias said spheroid holder means into said second tilted position thereof.

5. The clock apparatus of claim 4 wherein said spheroid holder means are comprised of generally shallow tray-like container members, each pivotally mounted to pivot about a transverse axis along the intermediate length thereof and having a closed end portion and an oppositely disposed open end portion thereof, said container members having the open end portion thereof raised with respect to the closed end portion thereof with said container members in said first tilted position and said spheroids being moved along the container members to be firstly retained by the closed end portion and thereafter progressively retained through stacked engagement with each other, and further having the closed end portion thereof raised with respect to the open end portion thereof with said container members in said second tilted position with said spheroids being progressively removed from said container members.

6. The clock apparatus of claim 5 wherein there are provided three of said container members, a first container member which receives and retains a first number of moving spheroids when in said first tilted position thereof, one spheroid greater in number than said first number when received thereon being effective to move said first container member to said second tilted position thereof to unload said first number of spheroids, a second container member which receives and retains a second number of moving spheroids when in said first tilted position thereof, one spheroid greater in number than said second number when received thereon being effective to move said second container member to said second tilted position thereof to unload said second number of spheroids, and a third container member which receives and retains a third number of moving spheroids when in said first tilted position thereof, one spheroid greater in number than said third number when received thereon being effective to move said third container member to said third tilted position thereof to unload said third number of spheroids.

7. The clock apparatus of claim 6 wherein said first container member has thereon increasing order indicia numerals referencing time of day measured in one minute increments of time, said second container member has thereon increasing order indicia numerals referencing time of day measured in five minute increments of time, and said third container member has thereon increasing order indicia numeral referencing time of day measured in one hour increments, and the last received spheroids thereon visually indicate attained hours and minutes by the accumulated order thereof for providing an attained time of day measurement as read from the aligned indicia numerals.

8. The clock apparatus of claim 6 wherein said first biasing means for each of said container members is firstly comprised of a single spheroid affixed in stationary position on the closed end portion thereof and removed from said transverse pivot axis to pivot said open end portion of the container member to said raised position with respect to the closed end portion thereof, respectively, said first biasing means being secondly comprised of all retained spheroids similarly removed from said pivot axis, and said second biasing means is firstly comprised of all retained spheroids oppositely removed from said pivot axis and is secondly comprised of said one spheroid greater than the number of retained spheroids.

9. The clock apparatus of claim 6 wherein said collecting means comprise an interconnnnected plurality of chute assemblies including a storage chute assembly, a first chute assembly receiving thereon loaded spheroids from said loading means and being aligned with the open end of said first container member with said first container member being in said first tilted position thereof to receive said loaded spheroids, second and third chute assemblies selectively receiving unloaded spheroids from said first and second container members, respectively, and having portions thereof aligned with said open ends of said first and second container memebers when in the second tilted position thereof, respectively, and other portions thereof aligned with said open ends of said second and third container members for passing said unloaded spheroids thereto with said second and third container members in said first tilted positions thereof, and fourth, fifth and sixth chute assemblies having portions thereof aligned with said open ends of said first, second and third container members with said container members in the second tilted positions thereof, respectively, for selectively receiving all other unloaded spheroids therefrom and passing said spheroids to said storage chute assembly for reloading access thereof.

10. The clock apparatus of claim 8 wherein there are provided four retained spheroids on said first container member when fully loaded and the fifth spheroid to be received is removed and causes the movement of said first container member to said second tilted position thereof to remove the four retained spheroids, eleven retained spheroids on said second and third container members, respectively, when fully loaded and the twelfth spheroids to be received thereon are removed, respectively, and cause the movement of said second and third container members to said second tilted positions thereof and to remove the eleven retained spheroids, respectively.

11. The clock apparatus of claim 10 wherein said fifth spheroid removed from said first container member is added to said second container member and the twelfth spheroid removed from said second container member is added to said third container member.

12. The clock apparatus of claim 9 wherein said first, second and third container members are disposed in vertical alignment with respect to each other, said first container member comprising a topmost one thereof and said third container member comprising a lowermost one thereof, said container members being pivotally raised or lowered from generally horizontal level positions whereby movement of said spheroids are enhanced by gravity forces.

13. A handless clock apparatus comprising in combination a base member including support structure means thereon, a plurality of generally elongated holder members supported on said support means for pivoting movement about a pivot axis selectibly positioned along the intermediate length thereof, respectively, means for biasing any of said holder members into one pivoted position thereof, respectively, a plurality of spherical units, selected ones thereof being contained on said holder members, the progressive numbers of which indicate progressively attained time-of-day measurements, loading means for loading other selected ones of said spherical units onto said holder members, a predetermined number of said other selected spherical units comprising means for counter biasing said loaded holder members into another pivoted position thereof, respectively, to remove said contained spherical units therefrom, and chute means for collecting said removed spherical units to be included with said other selected spherical units for reloading thereof.

14. The clock apparatus of claim 13 wherein there are provided at least a pair of holder members disposed in vertical alignment with respect to each other comprising a topmost one thereof and a lowermost one thereof, and said holder members being pivotally raised and lowered from generally horizontal level positions whereby movements of said spheroids are enhanced by gravity forces.

15. A clock apparatus comprising in combination support structure means, chute assembly means supported thereon, a plurality of spheroid means movable along said chute assembly means, movable spheroid holder means supported by said support structure means and being aligned when in a first position thereof to receive a predetermined number of said movable spheroid means from said chute assembly means and aligned when in a second and opposite position thereof to impart said received movable spheroid means to said chute assembly means, said spheroid holder means having time of day indicia numerals thereon and said moving spheroid means coming to rest thereon in progressive alignment with next higher order ones of said time of day indicia numerals whereby the placement order of said spheroid means indicates attained time of day, and time referenced loading means for loading with predetermined time referenced motion thereof said spheroid means on to said chute assembly means.

16. The clock apparatus of claim 15 wherein said chute assembly means has a first portion thereof retaining said spheroid means at rest, selected ones thereof being positioned for loading on to said time referenced loading means, and said time referenced loading means being effective with said predetermined time referenced motion thereof to progressively load said selected spheroid means thereon and to progressively impart said selected spheroid means on to said chute assembly means.

* * * * *